US005826726A

United States Patent [19]

Yang

[11] Patent Number: 5,826,726

[45] Date of Patent: Oct. 27, 1998

[54] PULP MOLD AND MOLDING MEANS FOR MANUFACTURING THE SAME

[76] Inventor: Chun-Tse Yang, 10, Alley 1, Lane 3, Wen-Chien Road, Niao-Sung Hsiang, Kaohsiung County, Taiwan

[21] Appl. No.: 673,080

[22] Filed: Jul. 2, 1996

[51] Int. Cl.[6] ..... B65D 81/127

[52] U.S. Cl. ..... 206/586; 206/592

[58] Field of Search ..... 206/591, 592, 206/593, 594, 521, 523, 585, 586; 229/406, 407

[56] References Cited

U.S. PATENT DOCUMENTS

| | | | |
|---|---|---|---|
| 1,929,918 | 10/1933 | Dreyer et al. | 206/591 |
| 1,958,050 | 5/1934 | Koppelman | 206/594 |
| 2,863,595 | 12/1958 | Emery | 206/592 |
| 2,874,826 | 2/1959 | Matthews et al. | 206/591 |
| 3,095,970 | 7/1963 | Gaulke | 206/586 |
| 3,101,166 | 8/1963 | Antwerpen | 206/591 |
| 3,231,454 | 1/1966 | Williams | 206/594 |
| 3,362,609 | 1/1968 | Freedy | 206/592 |

FOREIGN PATENT DOCUMENTS

| | | | |
|---|---|---|---|
| 93016940 | 9/1993 | WIPO | 206/591 |

*Primary Examiner*—Paul T. Sewell
*Assistant Examiner*—Luan K. Bui
*Attorney, Agent, or Firm*—Ladas & Parry

[57] ABSTRACT

A pulp mold comprises at least a cushion section for positioning and cushioning an article. In one embodiment of the invention, the cushion section is comprised of a plurality of pulp mold strips, and in other embodiments, the cushion section is formed by a number of successive pulp mold units, each unit defining a ridged surface on the pulp mold. A molding means for manufacturing the units comprises upper mold members and lower mold members, together defining the units, with each lower mold member being connected between two successive upper mold members. The upper mold members are used to form the ridged surfaces of the units for contact with an external packing material, such as a cardboard box or a carton, and the lower mold members, in addition to defining the units with the upper mold members, are used to form bottom surfaces each connecting two successive units. These bottom surfaces define an envelop plane completely fit with the contour of the article to be packaged. When the contour of the article changes, only the lower mold members are replaced and the upper mold members can be retained.

2 Claims, 8 Drawing Sheets

PULP MOLD AND MOLDING MEANS FOR MANUFACTURING THE SAME

BACKGROUND OF THE INVENTION (I) Field of the Invention

The present invention relates generally to pulp mold technology for packaging articles and more X specifically to a pulp mold for positioning and cushioning an article, i.e. a container for the article made of molded pulp, and a molding means for manufacturing the pulp mold.

(II) Description of the Prior Art

Conventional packaging materials, such as those used to hold agricultural products or food, e.g., fruits, eggs, cans or fresh meat, or industrial products, e.g., computer parts, electronic components, electrical appliances and porcelain products, are usually made of polylone or EPE foam materials. As is well know, these materials are bulky, highly inflammable and spontaneous combustible, un-degradable, toxical and non-recyclable, and thus cause significant problems in environmental protection. EPE foam material contains CFC which is known to be detrimental to the ozone of the atmosphere and is even worse to the earth environment.

To overcome the disadvantages of the conventional packaging materials, most of the countries that have long engaged in environment protection save no effort in finding substitutes and use more and more pulp mold packaging materials. Since the raw material of pulp molds comes from recycled paper and is free from tree felling, the pulp molds are fully suitable in view of the increasingly desired environmental concerns. As to the conventional polylone and EPE foam materials, the pulp mold materials require less space and will not generate toxicant substances when burning. The fibrous contents of the pulp mold materials are capable of absorbing humidity. Furthermore, the pulp mold materials are not spontaneous combustive.

However, the existing pulp mold materials are designed to hold or support articles only. Specifically, they only function to position articles and provide no cushioning effect to the packaged articles. That is, the conventional pulp mold materials cannot minimize damages on the packaged articles due to collision or impact during shipping. Besides, the conventional molding devices for making pulp molds can only be used for a specific design. More specifically, when there is a change in the contour or shape of an article, a new molding device will be required for such a change. As a result, the conventional molding devices provide no flexibility in use.

SUMMARY OF THE INVENTION

It is an object of the present invention to provide a pulp mold for packaging articles and providing functions of positioning and cushioning for the packaged articles. The pulp mold in accordance with the invention comprises at least a cushing section formed by a plurality of pulp mold units, each unit being a ridged surface on the pulp mold.

It is a further object of the present invention to provide a molding means including upper mold members and lower mold members for making the pulp mold units and in turn the pulp mold. The upper mold members, together with the lower mold members, are provided to form the ridged surfaces of the pulp mold units, and the lower mold members are adapted to fit with the contour of an article to be packaged.

The foregoing and other objects, aspects and advantages of the present invention can be better understood from the following detailed description.

DETAILED DESCRIPTION

Figure 1A:
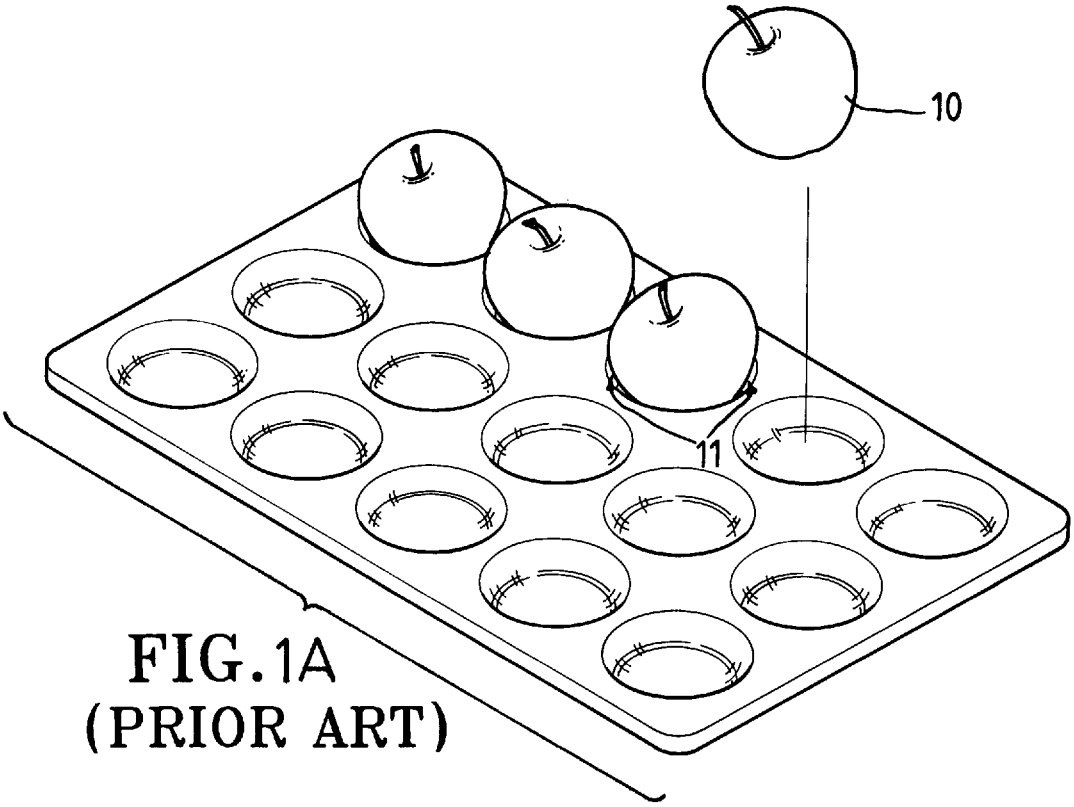
FIG.1A (PRIOR ART)
FIG. 1A shows a prior art pulp mold used to support fruit or eggs.
Figure 1B:
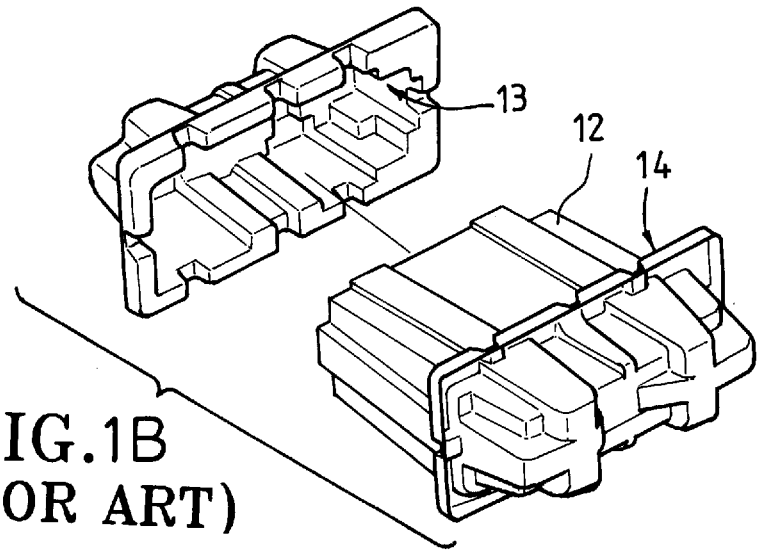
FIG.1B (PRIOR ART)
FIG. 1B shows a prior art pulp mold used to package an article having a ragged contour.

FIG. 1A and 1B respectively show the schematic views of conventional pulp molds for supporting fruits or eggs and for supporting industrial parts having rugged contours. As shown in FIG. 1A, the prior art pulp mold is formed with recessed portions for receiving articles 10, such as apples, having a substantially circular cross-section. The prior art pulp mold shown in FIG. 1B is to hold an article 12 such as an electronic product or a mechanical device that has a rugged contour. The prior art pulp mold has recessed sections 13, 14 corresponding to the contour of the article 12 so as to hold the article 12 therein. The known pulp molds are provided to hold or support the packaged articles alone and provide no cushion effect to protect the packaged articles from impact or collision during shipping. In other words, the prior art packaging materials connote minimize the damage the articles may suffer.

Figure 2:
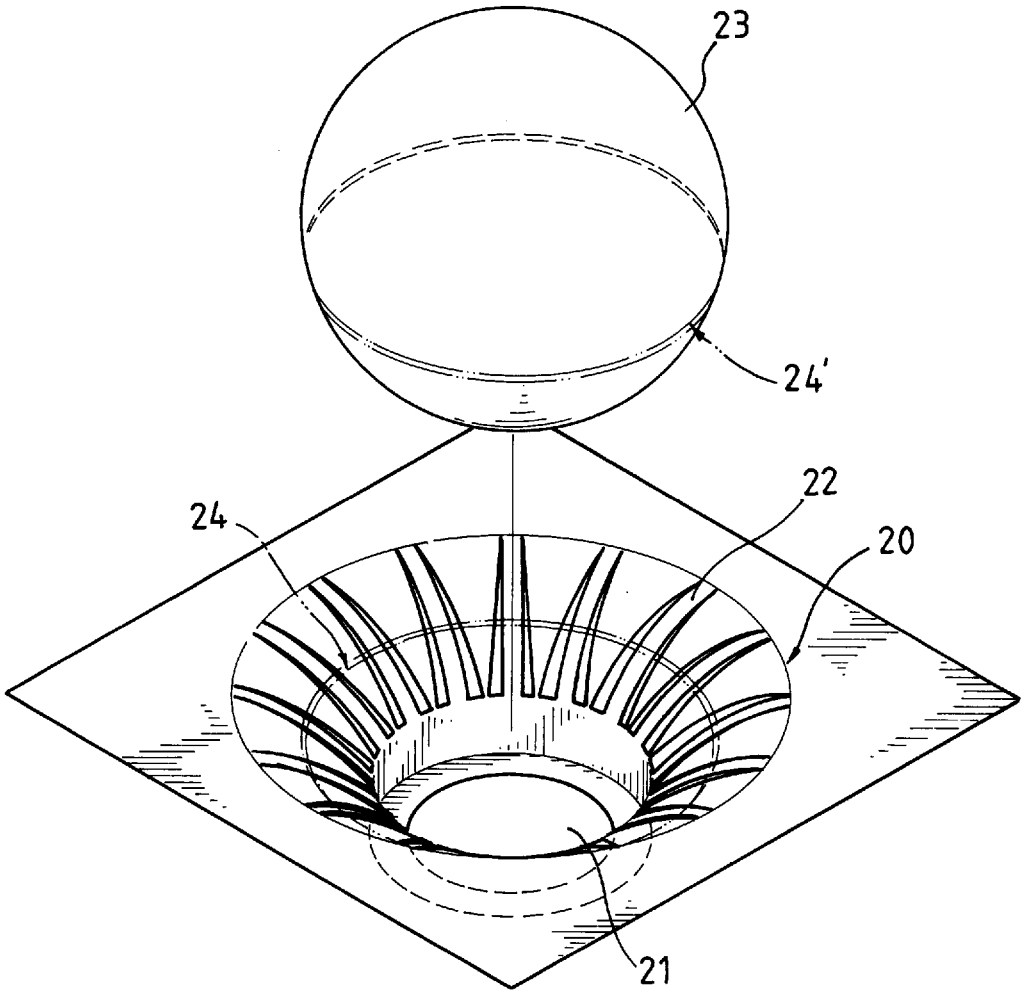
FIG. 2 is a schematic view showing the pulp mold in accordance with an embodiment of the present invention for packaging an article having a substantially circular cross-section.

FIG. 2 shows an embodiment in accordance with the present invention. The pulp mold shown in FIG. 2 is to position and cushion articles having a substantially circular cross-section. These articles may include for example fruits, eggs and cans. In this embodiment, a substantially cylindrical recess 20 is formed in the pulp mold. The opening of the recess 20 has an inner diameter substantially greater than that of the bottom 21 of the recess 20. The bottom 21 is provided with a hole for ventilation. A cushion section 22 formed by a plurality of spaced pulp mold strips defines the inner wall of the recess 20. Each strip extends from the periphery of the opening to the bottom 21. The cushion section 22 provides a "surface-to-surface" contact with an article 23 to be packed. The surface-to-surface contact is accomplished when the ring zones 24 and 24' are engaged. The prior art shown in FIG. 1A typically provides "point-to point" contact alone because the prior art pulp mold is formed with recesses of uniform dimension and there often exists a gap 11 when an article is put in one of the recesses. Consequently, the prior art packaging material connote securely hold the packaged article, and typically, uses sponge pads to compensate the gap 11. This solution requires undesirable materials which further cause more environmental protection problems and increase the cost. On the contrary, in the present invention, due to the cushion section 22, not only can the packaged article 23 be more securely held, but also a cushion effect is provided by virtue of the resiliency of the pulp mold fibers.

Figure 3A:
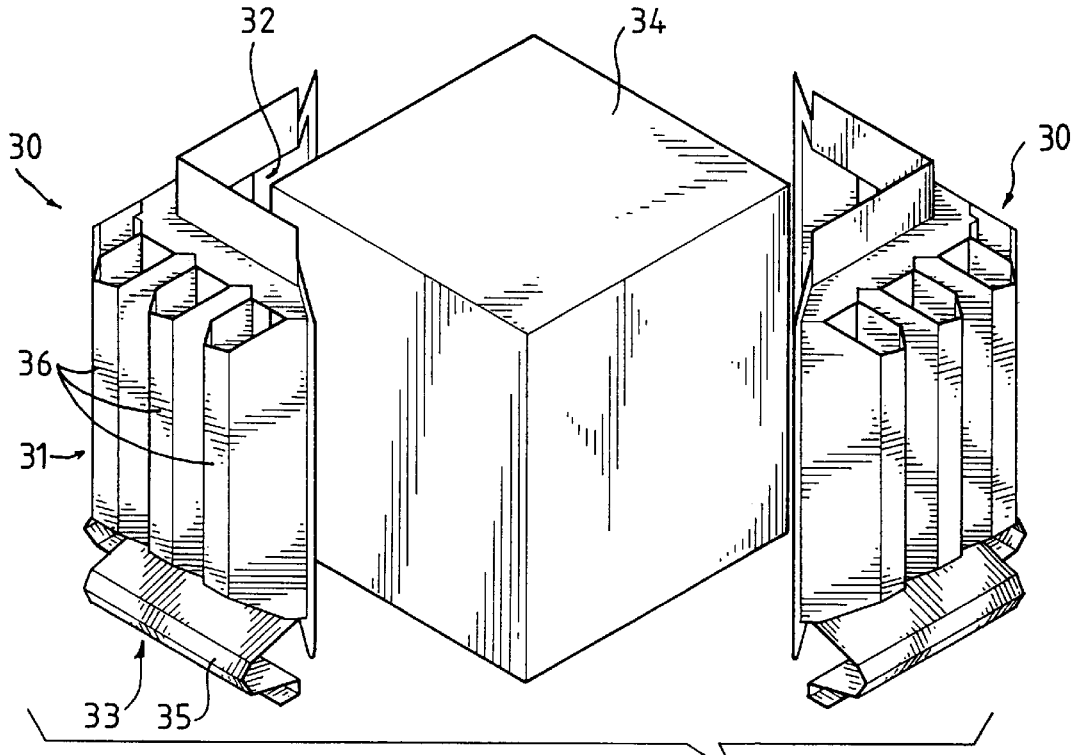
FIG. 3A and 3B are schematic views showing the pulp mold in accordance with another embodiment of the present invention for packaging an article having a substantially rectangle cross-section.
Figure 3B:
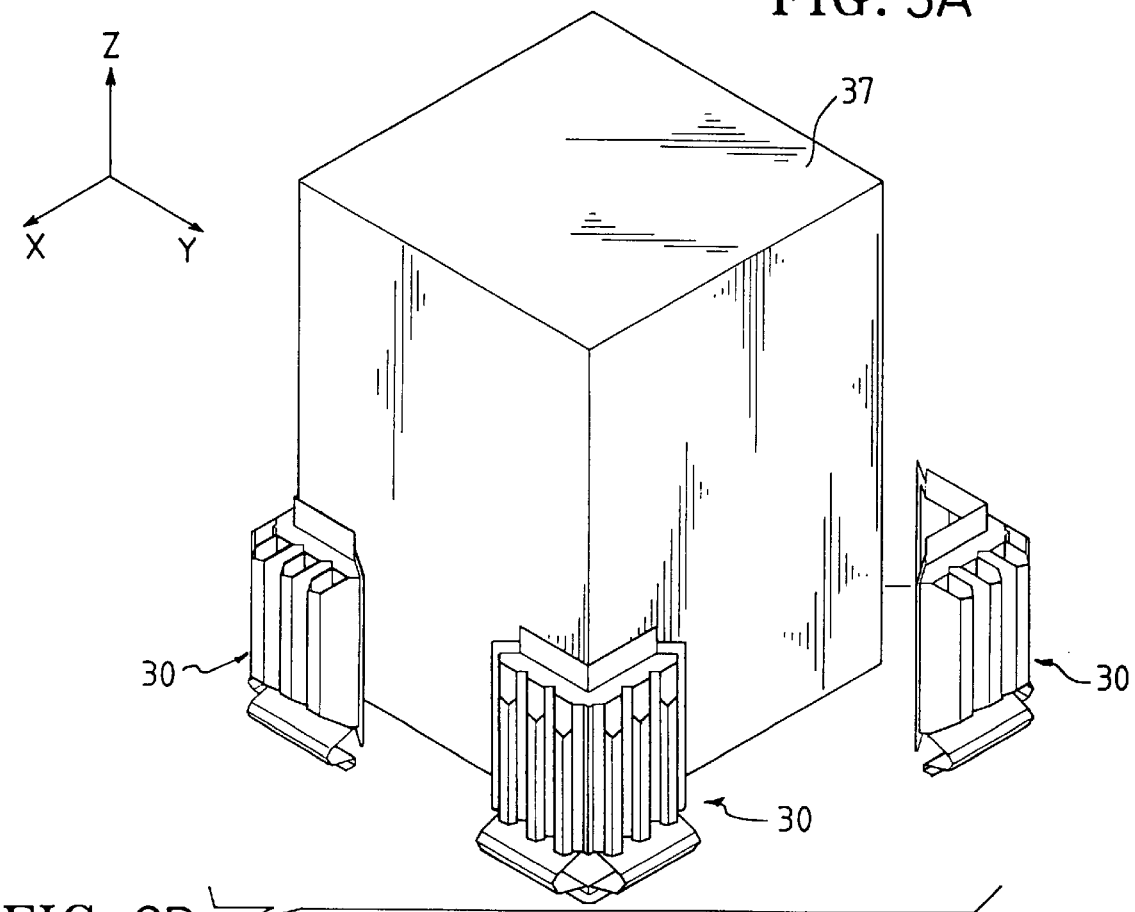

FIGS. 3A and 3B show another embodiment of the present invention. As shown in FIG. 3A, in this embodiment, the pulp mold 30 is designed with cushion sections 31, 32 and 33 respectively arranged in X, Y and -Z (negative Z) direction (Cartesian coordinate system) to enclose an article 34 having a substantiably rectangle cross-section. The article 34 may be the actual object to be packed or an outside wrappage that contains an article. The cushion section 33 in the negative Z direction is constructed with a plurality of successive units 35 extending longitudinally. The units 35 comprise ridged surfaces raised from the surface of the pulp mold 30 and having for example semi-circular, square or triangular shapes. The cushion sections 31 and 32 respectively in the X and Y directions are formed with a number of laterally extending units 36.

FIG. 3B shows an alternative use of the pulp mold 30. In this embodiment, an article 37 is packed at four or eight corners thereof by the pulp mold 30.

Although not illustrated, it can be easily understood that the cushion section (31,32) can be arranged at an angle greater than orthogonal to each other as shown in FIG. 3A so as to cover a substantially cylindrical article.

Figure 4:
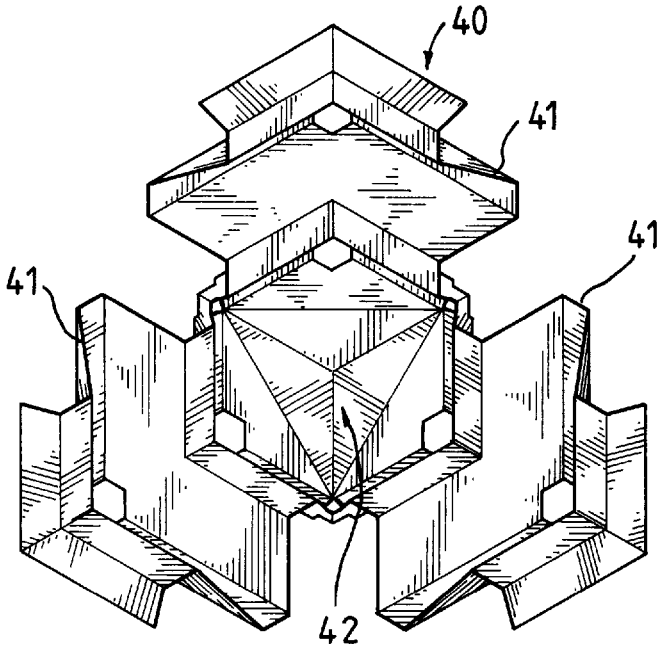
FIG. 4 shows an alternative of the present invention shown in FIG. 3.
Figure 4:
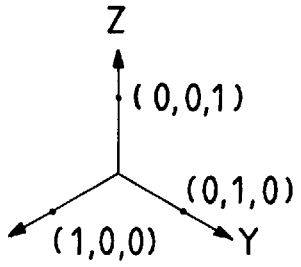

FIG. 4 is an alternative embodiment of the present invention shown in FIG. 3, in which a pulp mold 40, like the pulp mold 30 shown in FIGS. 3A and 3B, is applied to two, four or eight corners of a substantially rectangle cross-section article. However, when the receptacle section 42 of the pulp mold 40 is fit into the corner, the pulp mold 40 provides cushioning function along each of the three orthogonal axes, namely X, Y and Z directions or alternatively in the (1,0,0), (0,1,0) and (0,0,1) orientation, by means of the cushion sections formed by units 41 successively arranged along the axes.

Figure 5:
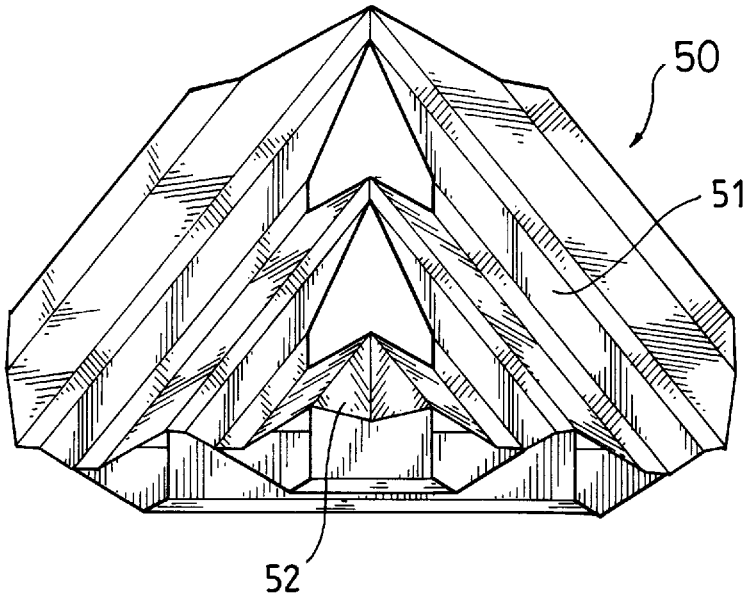
FIG. 5 shows a further alternative of the present invention shown in FIG. 3.
Figure 5:
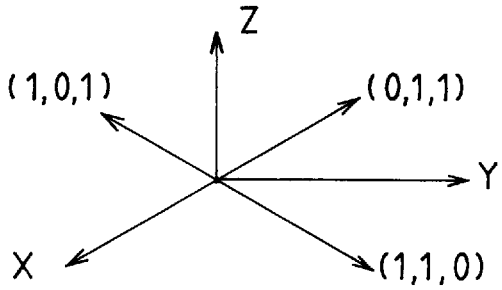

FIG. 5 is yet an alternative embodiment of the present invention shown in FIG. 3, in which the pulp mold 50 is also applicable to two, four or eight corners of a substantially rectangle cross-section. However, when the receptacle section 52 of the pulp pad 50 is fit in a corner of the article, units 51 that form a cushion section are provided in a successive manner along each of the (1,1,0), (0,1,1) and (1,0,1) orientation rather than the (1,0,0), (0,1,0) and (0,0,1) orientation illus in FIG. 4.

Figure 6A:
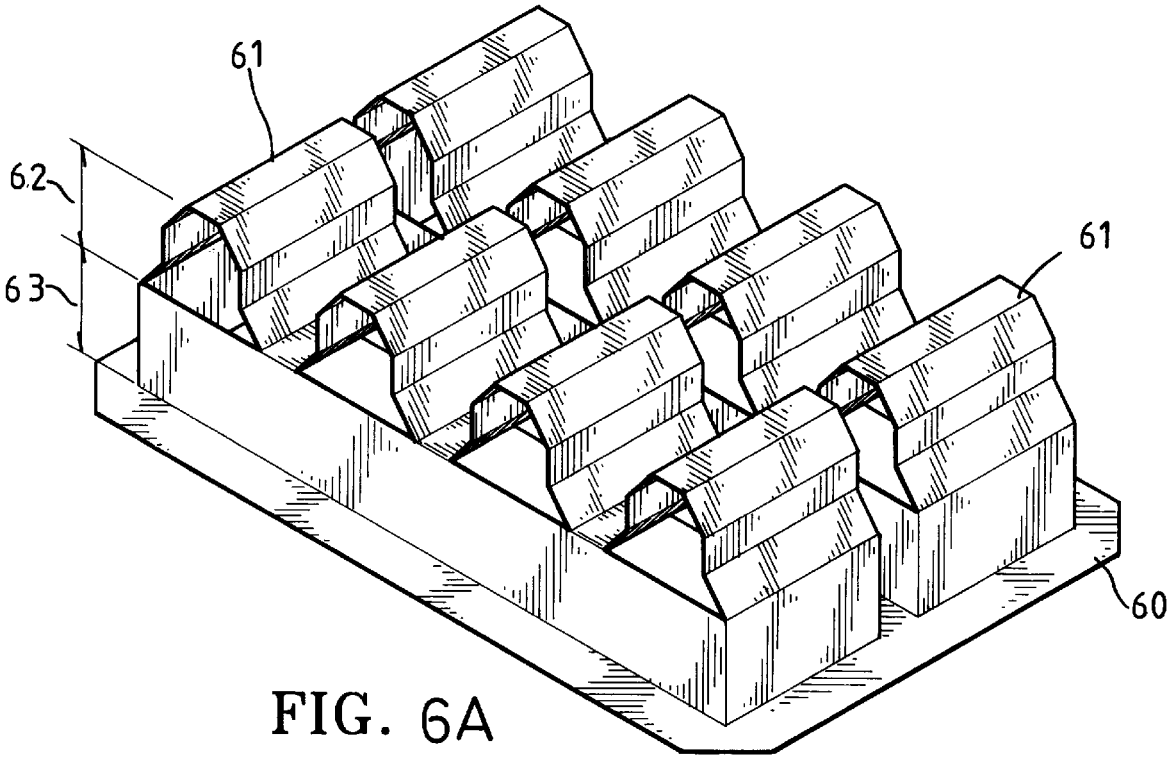
FIG. 6A shows a fortified pulp mold in accordance with the present invention.
Figure 6B:
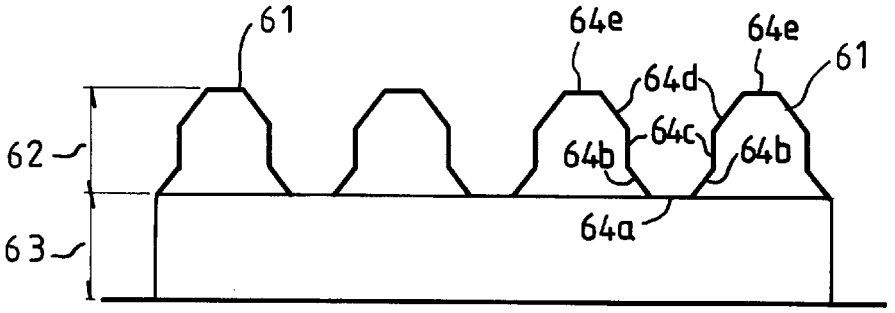
FIG. 6B is a side view of FIG. 6A.

FIG. 6A shows a pulp mold 60 in accordance with another embodiment of the present invention, which comprises cushion sections formed by a plurality of pulp mold units 61. As illustrated, four units form a cushion section. Each unit 61 has a ridged surface which is not simply constituted by elementary geometrical shapes, such as semi-circular, triangle or square, but is formed with a terraced section 62, each of two terrace members 64*b* and 64*d*, at both sides of the ridged surface of central members 64*c* to define a configuration having a narrow upper surface of joining members 64*c* and a wide lower region. The pulp mold 60 is also provided with a base 63 to which the bottom surfaces of joining members 64*a* that connect the units 61 are connected. In addition to providing shock-absorption and cushion effect to the packaged article, the units formed with the terraced section 62 also provide additional resistance to the pressure from upward. The base 63 is to provide further support to the units 61 to prevent them from collapsing, thereby forming a fortified pulp mold structure..

Figure 7A:
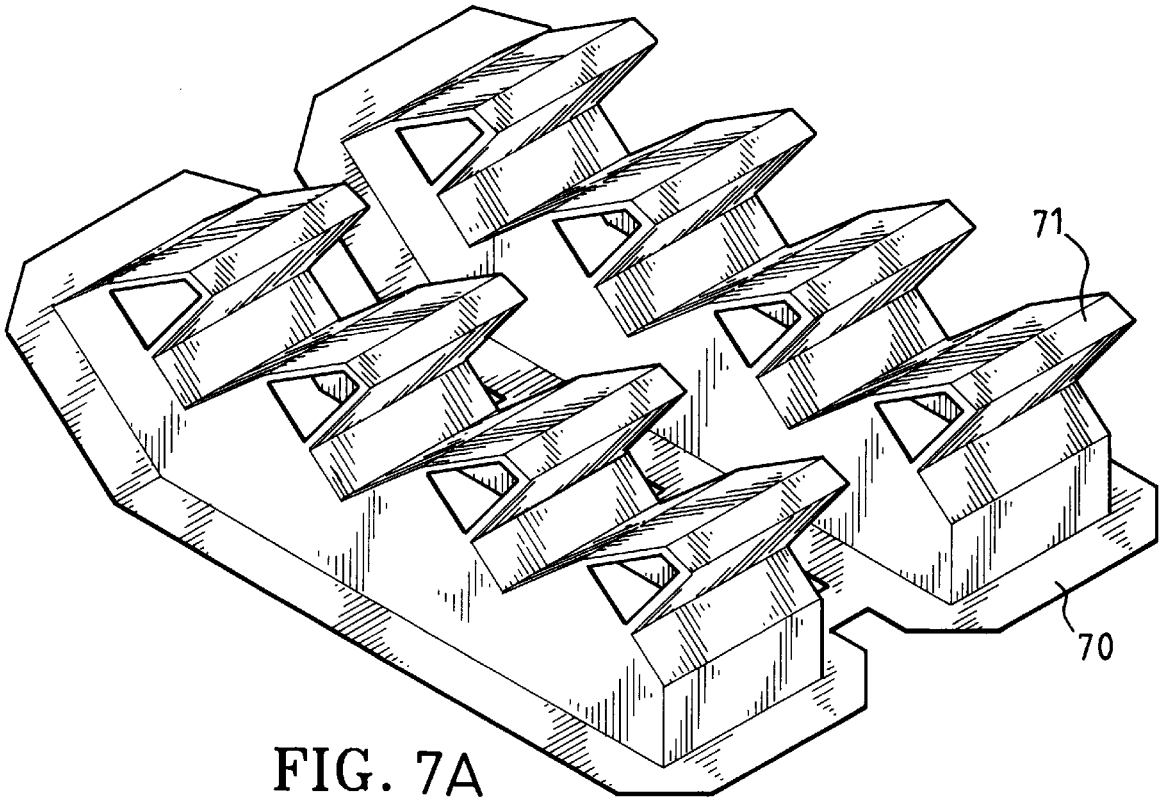
FIG. 7A shows yet another fortified pulp mold of the invention.
Figure 7B:
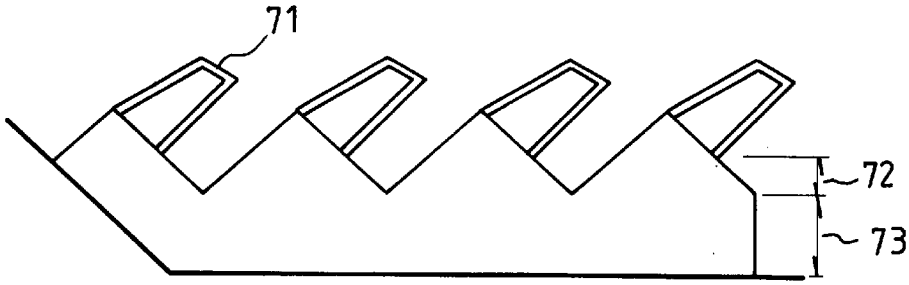
FIG. 7B is a side view of FIG. 7A.

FIG. 7A shows a pulp mold 70 also having a fortified structure, which comprises a cushion section constructed with a plurality of units 71. As illustrated, four units form a cushion section. As compared with the embodiment shown in FIG. 6A, the units 71 comprise a terraced section 72 at one side of the ridged surface alone, and a base 73.

Figure 8A:
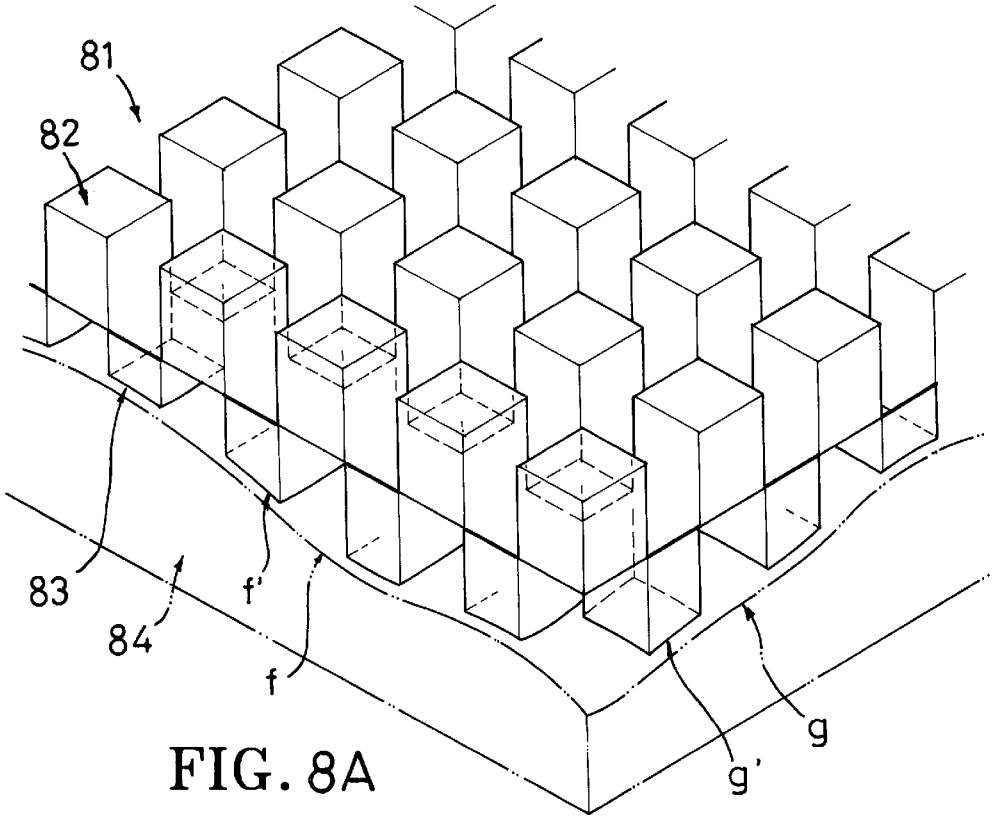
FIG. 8 shows the molding means for making the pulp mold units of the present invention.

The present invention also provides a molding means for making the units. FIG. 8A shows a finished pulp mold 81. The pulp mold 81 comprises a cushion section constructed with a plurality of pulp mold units 82, as illustrated, are arranged as a unit matrix to be contact with an external packaging material such as a carton or cardboard box (not shown). The bottom surfaces 83 each connecting two successive units can be shaped in accordance with the contour of the article 84 to be packaged. In the embodiment, the article 84 has a contour defined by curved lines f and g in the horizontal plane. The bottom surfaces 83 are designed to form an envelop plane by curved lines f' and g' corresponding to the curved lines f and g so as to closely fit with the article 84.

Figure 8B:
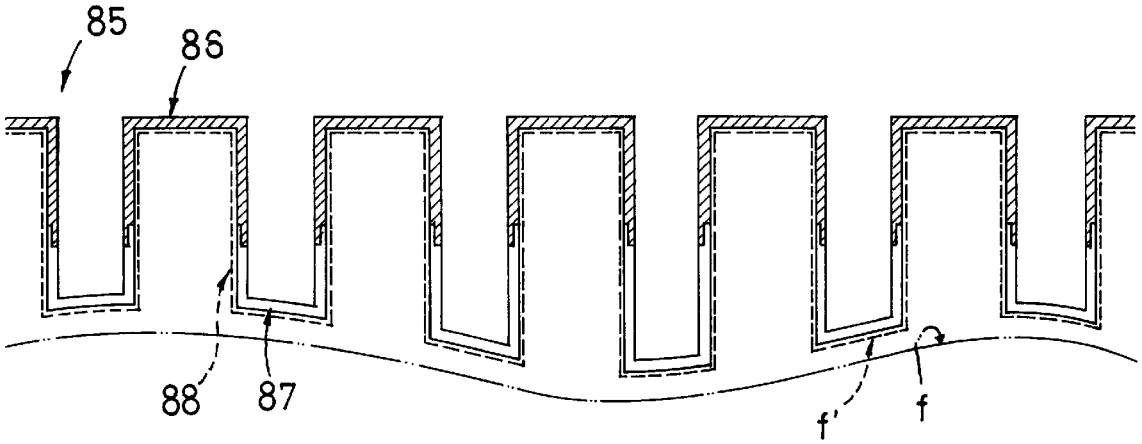

FIG. 8B shows a molding means 85 for making the pulp mold 81 shown in FIG. 8A. The molding means 85 comprises upper mold members 86 (hatched regions) and lower mold members 87 (non-hatch regions), each lower mold member connecting two successive upper mold members. The upper and lower mold members 86 and 87 together define the configuration of the units 82, such as semi-circle, triangle, square or the terraced configuration. The lower mold members 87 are also used to form the bottom surface 83 such that an envelop plane can be defined to correspond to the contour of the article. In FIG. 8B, the dashed line 88 represents the pulp mold units attached to the upper and lower mold members, which will then be dehydrated, baked and possibly further processed to form the pulp mold 81.

In the molding means 85 of the present invention, the upper mold members 86 may be repeatedly used even when the contour of the article to be packaged changes, such as having a contour defined by another curved contour line h (not shown). In such a case, only the lower mold members 87 are re-designed to meet the new contour and the upper mold members 86 can be retained.

The prior art molding means for making pulp molds as shown in FIGS. 1A and lB, on the contrary, take the form of integral mold members so that the entire molding means are no longer useful as design changes. Quite obviously, the molding means in accordance with the present invention is flexible and economic in use.

As discussed above, the present invention provides a pulp mold that has cushioning and shock-absorption features and a molding means for manufacturing the pulp mold units of the pulp mold that can partially be repeatedly used in different designs. Although the present invention has been described with reference to the specific preferred embodiments, those skilled in the art may make a variety of modifications and changes without departing from the scope of the present invention which is defined by the appended claims.

What is claimed is:

1. A molded pulp container for an article, comprising:

a first joining member having parallel opposite sides defining a plane;

first terrace members respectively having first sides connected to the opposite sides of the first joining member and projecting from the plane of the first joining member at opposite oblique angles to opposite sides of the first terrace members;

central members respectively having first sides connected to the opposite sides of the first terrace members and projecting generally perpendicularly to the plane of the first joining member to opposite sides of the central members;

second terrace members respectively having first sides connected to the opposite sides of the central members and projecting relative to the plane of the joining member at opposite oblique angles to opposite sides of the second terrace members; and second joining members respectively having first sides connected to the opposite sides of the second terrace members and projecting generally parallel to opposite sides, whereby the opposite sides of the second joining members are respectively connectable to opposite sides of second terrace members of other molded pulp containers for other articles, wherein all the members are made of molded pulp.

2. The molded pulp container for an article according to claim 1, wherein the first joining member has opposite ends, and further comprising a base connected to the opposite ends of the first joining member.

* * * * *